United States Patent [19]

Yonese et al.

[11] Patent Number: 5,035,954

[45] Date of Patent: Jul. 30, 1991

[54] HEAT-SENSITIVE RECORD MATERIAL AND METHOD FOR PRODUCING IT

[75] Inventors: Naoki Yonese, Nishinomiya; Mikio Nakamura, Kobe; Masato Kawamura, Amagasaki; Yukio Takayama, Toyonaka, all of Japan

[73] Assignee: Kanzaki Paper Manufacturing Co., Ltd., Tokyo, Japan

[21] Appl. No.: 397,006

[22] Filed: Aug. 22, 1989

[30] Foreign Application Priority Data

Sep. 5, 1988 [JP] Japan ..... 63-222158

[51] Int. Cl.[5] ..... B41M 5/26

[52] U.S. Cl. ..... 428/500; 427/146; 427/152; 428/195; 428/207; 428/323; 428/331; 428/913; 428/914

[58] Field of Search ..... 428/195, 207, 500, 913, 428/914, 323, 331; 427/152, 146

[56] References Cited

U.S. PATENT DOCUMENTS

| | | | |
|---|---|---|---|
| 4,168,845 | 9/1979 | Oeda et al. | 428/913 |
| 4,246,312 | 1/1981 | Kosaka et al. | 438/207 |

FOREIGN PATENT DOCUMENTS

| | | | |
|---|---|---|---|
| 0186375 | 12/1985 | European Pat. Off. | 503/200 |
| 3700299 | 1/1986 | Fed. Rep. of Germany | 503/200 |
| 2001571 | 1/1987 | Japan | 503/200 |
| 2183354 | 6/1987 | United Kingdom | 503/200 |

*Primary Examiner*—Pamela R. Schwartz

[57] ABSTRACT

The heat-sensitive record materials have, between the base sheet and the recording layer, a middle layer which mainly comprises a binder and at least one pigment having an oil absorption of at leasat 80 cc/100 g measured by JIS K 5101. The middle layer comprises an acrylic thickener in an amount of 0.05 to 5 parts by weight per 100 parts by weight of the pigment on dry basis.

The middle layer is formed by blade-coating on a base sheet a coating composition comprising at least one pigment having an oil absorption of at least 80 cc/100 g measured by JIS K 5101 and a binder, in which an acrylic thickener is comprised in such amount as described above.

11 Claims, No Drawings

HEAT-SENSITIVE RECORD MATERIAL AND METHOD FOR PRODUCING IT

BACKGROUND OF THE INVENTION

This invention relates to a heat-sensitive record material, particularly a heat-sensitive record material which is superior in record sensitivity and can develop color images having a good quality, and to a method for producing the heat-sensitive record material.

There has been well known heat-sensitive record materials utilizing the colorforming reaction between a basic colorless chromogenic material and an electron accepting acidic color developing material, in which color images are produced by heating to contact with each other of the basic colorless chromogenic material and the electron accepting acidic color developing material. The heat-sensitive recording materials are relatively cheep and the recording machine is compact and easy to maintain. Accordingly, they have been used in various fields as well as a record medium in facsimiles, computers and the like.

The recording speed becomes higher and resultantly requirements for the heat-sensitive record materials superior in dynamic record sensitivity have been increased. Further, the applied fields becomes wider. It is required for the heat-sensitive record material to develop color images having a good quality in any color density.

In order to satisfy the requirements, it has been proposed to form a middle layer between the base sheet and the recording layer. However, the required conditions such as coating method, coating composition and concentration of it have not yet been satisfactly studied, and a practical useful middle layer has not been obtained.

The object of the invention is to provide a heat-sensitive record materials having a very effective middle layer between the base sheet and the recording layer, which can develop color images superior in color density and having a good image quality.

SUMMARY OF THE INVENTION

The heat-sensitive record materials according to the invention have, between the base sheet and the recording layer, a middle layer which mainly comprises a binder and at least one pigment having an oil absorption of at least 80 cc/100 g measured by JIS K 5101. The middle layer comprises an acrylic thickener in an amount of 0.05 to 5 parts by weight per 100 parts by weight of the pigment on dry basis.

The heat-sensitive record materials is prepared by blade-coating on a base sheet a coating composition comprising at least one pigment having an oil absorption of at least 80 cc/100 g measured by JIS K 5101 and a binder, in which an acrylic thickener is comprised in an amount of 0.05 to 5 parts by weight per 100 parts by weight of the pigment on dry basis, and forming a recording layer on the middle layer.

DETAILED DESCRIPTION OF THE INVENTION

In the heat-sensitive record materials according to the invention, there is formed, as described above, between the base sheet and the recording layer a middle layer mainly comprising a specific oil absorbing pigment and a binder and further comprising an acrylic thickener in a specific ratio. Particularly, a remarkable effect is obtained by blade-coating to form the middle layer.

As the pigments having an oil absorption of at least 80 cc/100 g measured by JIS K 5101, there are exemplified pigments having the above specific oil absorption, such as calcined clay, aluminum oxide, titanium oxide, magnesium carbonate, diatomaceous earth, amorphous silica, aluminum silicate, magnesium silicate, calcium silicate, sodium alminosilicate, magnesium alminosilicate and the like; and modified pigments which are obtained by physically or chemically treating general organic or inorganic pigments to have the above specific oil absorption. Among the pigments, calcined clay and amorphous silica are particularly superior in heat insulation so that they can effectively improve the record sensitivity of heat-sensitive record materials comprising them in the middle layer, and accordingly they are most preferably used.

Among the binders used with the pigments, there are exemplified water soluble polymers such as starch, casein, polyvinyl alcohols, methylcellulose, carboxymethylcellulose, hydroxyethylcellulose, polyacrylic acid and the like; and various synthetic resin emulsions, such as styrene-butadiene copolymer emulsions, styrene-acrylic acid copolymer emulsions, acrylonitrile-butadiene copolymer emulsions, emulsions of styrene-acryl ester copolymer complexed with colloidal silica, acryl acid copolymer emulsions and the like.

According to the invention, the middle layer is formed by coating a coating composition mainly comprising a specific oil absorbing pigment and a binder as described above. The coating composition further comprises an acrylic thickener in an amount of 0.05 to 5 parts by weight, preferably 0.1 to 1.7 parts by weight, per 100 parts by weight of the pigment on dry basis. If the acrylic thickener is used in an amount of less than 0.05 parts by weight, the coating composition is not sufficient in the thickening effect and it is difficult to prepare a coating composition having a good coating applicability. Particularly, a coating composition suitable for blade-coating can not be obtained and the record sensitivity of the record material can not be improved. On the contrary, if the acrylic thickener is used in an amount of more than 5 parts by weight, the coating composition is liable to be gelatinous and it is difficult to coat in a high concentration.

As the acrylic thickeners, there may be used acrylic polymers produced with use of at least one monomer selected from the group consisting of acrylic acid, acrylamide, methyl acrylate, ethyl acrylate, propyl acrylate, butyl acrylate, octyl acrylate, dodecyl acrylate, acrylonitoril, mechacrylic acid, methyl mechacrylate, ethyl methacrylate, propyl methacrylate, isopropyl methacrylate, butyl methacrylate and the like. The acrylic polymers in which at least one polar group such as carboxylic acid, amine, amide, ester, ether or the like is comprised are preferably used, because the polar group easily form hydrogen bonds with a high polymer to increase the water retention.

Generally, the acrylic thickener is used in the form of an aqueous emulsion. There is preferably used an aqueous emulsion mainly comprising an acrylic polymer soluble or swellable in alkaline water, for example an acrylic polymer which can be dissolved or swelled by adding a basic compound such as aqueous ammonia, causic soda or the like in the emulsion to increase the viscosity and the water retention of the coating composition by the generation of chemical bonds (hydrogen bonds) between the polymer and water molecules and the physical property of the polymer to include water molecules.

Particularly, as the acrylic thickener, there is preferably used that having a viscosity of at least 50 cps which is obtained by diluting the thickener to produce an aqueous solution or dispersion having a solid amount of 1% by weight, adjusting the pH of the solution to 8.0 with an alkaline solution such as an aqueous solution of ammonia, causic soda or the like, and measuring the viscosity of it by B-type viscosimeter (12 rpm) at 25° C.

The above emulsion may be that mainly comprising either a crosslinked acrylic polymer or a noncrosslinked acrylic polymer. The most preferable acrylic thickener is an aqueous emulsion mainly comprising a noncrosslinked acrylic polymer soluble in an alkaline water, because an excellent thickening effect and a good water retention are given the coating composition by using it together with a specific oil absorbing pigment.

Further, in order to advance the rising of the viscosity of the coating composition and to obtain a stable thickening effect and a good water retention of the coating composition, there may be added, to the acrylic thickener at least one polyol compound having hydroxyl groups in the molecule such as ethylene glycol, glycerol, polyethylene glycols of a low polymerization degree. The added amount of these sub-component is preferably selected within the range of 20 to 40 parts by weight per 100 parts by weight of the acrylic thickener.

As thickeners used in coating compositions, there have been known such as sodium arginate, carboxymethylcellulose, methylcellulose and the like. However, the above acrylic thickener in the present invention is preferably an aqueous emulsion, and has the following advantages in comparison with the known thickeners. It is easily added to the coating composition and is not putrefied. Further, a highly concentrated coating composition can be prepared with it because of the relatively high solid content. Additionally, it is possible to prepare a coating composition efficiently applicable for blade-coating in a high concentration, because it is superior in improving the water retention of the coating composition to the general thickeners.

Further, since the water retention of the coating composition is improved according to the invention, it is possible to prevent the following troubles;

(1) lowering the coating applicability by increasing the viscosity of the coating composition applied on the base sheet, and resultantly producing streaks and scratches in the blade-coating process, (2) breaking the base sheet due to the absorption of an excess amount of water, and resultantly interrupting the coating process, (3) the medium of the coating composition, such as water, being easily absorbed by the base sheet to increase the concentration of the coating composition recovered from the coater head and resultantly to make it difficult to circulate the coating composition because of increasing the viscosity, (4) lowering the surface strength of the middle layer because of the penetration of an excess amount of binder into the base sheet, and the like.

Since the above specific pigments having a high oil absorption, as used to form the middle layer according to the invention, have a high bulkiness, the coating composition prepared with the pigments generally has a poor water retention. However, by using the pigments together with the above specific acrylic thickener, extremely good thickening effect and improved water retention effect can be achieved so that it is possible to prepare coating compositions stably applicable for blade-coating in a high concentration.

Incidentally, acrylic resin binders are different from the acrylic thickeners used in the invention, because the binders are not available as water retentive agents or thickeners.

The desired characteristics for the coating composition which is suitable for blade-coating in a high concentration are exemplified as follows:

(1) proper viscosity (to prevent the production of uncoated portions by stably supplying the coating composition)

(2) excellent fluidity under a high share force on coating head (to prevent the generation of streaking troubles such as streaks, stalactites and the like)

(3) proper water retention (to prevent the phenomenon in which water, latex and the like in the coating composition are slectively absorbed into the paper applied with it)

(4) heat stability (to prevent the lowering of the stability of the coating composition during the coating process)

The middle layer coating composition according to the invention satisifies these characteristics sufficiently so that it is stably applicable for blade-coating in a high concentration. Further, although the heat-sensitive record materials produced by applying a coating composition comprising a general thickener to form the middle layer only develop color images poor in color density and image quality, the heat-sensitive record materials produced by applying the coating composition according to the present invention which comprises a binder and an oil absorbing pigment together with a specific acrylic thickener to form the middle layer can develop color images superior in both of color density and image quality.

Among the blade-coating methods applied in the invention, there may be included not only methods using a Bevel type blade or a Bent type blade but also methods using a Rod blade, a Billblade or a Champflex. Further, the coater such as a short-dwell-time-coater in which the time required after applying an excessive coating composition on a base sheet to cut off the excess amount of it is short is used preferably, because of the good coating applicability of the middle layer coating composition mainly comprising an oil absorbing pigment. The middle layer of the invention, produced by blade-coating on a base sheet such specific coating composition as defined in the above, has a very smooth surface different from that produced by air-knife coating and the like. Accordingly, it is not necessary to apply an excessive super-calender treatment and the like, and voids in the middle layer are maintained in a high ratio to act as an heat insulator. Resultantly the application of blade-coating contributes to form heat-sensitive record materials which can produce color images having a high quality in a high sensitivity. Further, the drying speed of the coating layer is very high so that the required equipments and energies are remarkably reduced.

Into the middle layer coating compositions according to the present invention, there may be added general pigments or additives unless the desired effects of the invention are not inhibited. However, the used amount must be carefully selected. The coating amount of the middle layer is not particularly limited, but it is preferably selected within the range of 1 to 30 g/m$^2$ on dry basis depending on the desired properties of heat-sensitive record materials. The middle layer may be formed in the form of multi-layers.

The blade-coating of the coating composition may be applied with either off machine coater or on machine coater which is a coater attached on a paper machine to continuously carrying out paper-making and coating. Particularly, when wood free paper is used as a base sheet, on machine coators are preferably used, because a sufficient coated amount is easily obtained and the drying property is good due to the effects of the paper temperature immediately before coating.

Heat-sensitive record materials according to the invention are obtained by forming a heat-sensitive recording layer on thus obtained middle layer. The combination of color forming materials and color developing materials, which are comprised in the recording layer, is not particularly limited. Any combination can be used so far as color images are produced by heating to contact with each other of the color forming material and the color developing material. For example, there may be exemplified a combination of colorless or pale colored basic chromogenic materials and inorganic or organic acidic compounds, a combination of metal salts of higher fatty acids such as ferric stearate and phenols such as gallic acid, and the like. Further, various heat-sensitive record materials, in which the recording image is developed by heat, such as the heat-sensitive record material having a combination of diazonium compounds, coupling agents and basic compounds and the like.

However, the combination of colorless or pale colored basic chromogenic materials and inorganic or organic acidic compounds is very useful for the specific middle layer in the invention on the base sheet to obtain the desired advantages of the invention and accordingly most preferably used.

Among the colorless or pale colored basic chromogenic materials comprised in the record layer according to the present invention, there are exemplified triarylmethane compounds such as 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-6-dimethylaminophthalide, 3,3-bis(2-phenylindole-3-yl)-6-dimethylaminophthalide, 3-p-dimethylaminophenyl-3-(1-methylpyrrole-3-yl)-6-dimethylaminophthalide and the like; diphenylmethane compounds such as 4,4'-bis-dimethylaminobenzhydryl benzyl ether, N-halophenyl-leucoauramine, N-2,4,5-trichlorophenyl-leucoauramine and the like; thiazine compounds such as benzoyl-leucomethylene blue, p-nitrobenzoyl-leucomethylene blue and the like; spiro compounds such as 3-methyl-spiro-dinaphthopyran, 3-ethyl-spiro-dinaphthopyran, 3-phenyl-spiro-dinaphthopyran, 3-benzyl-spiro-dinaphthopyran, 3-methyl-naphtho-(6'-methoxybenzo)spiropyran, 3-propyl-spiro-dibenzopyran and the like; lactam compound such as Rhodamine-B anilinolactam, Rhodamine(p-nitroanilino)lactam, Rhodamine(o-chloroanilino)lactam and the like; and fluoran compounds such as 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7-methylfluoran, 3-diethylamino-7-(N-acetyl-N-methylamino)-fluoran, 3-diethylamino-7-N-methylaminofluoran, 3-diethylamino-7dibenzylaminofluoran, 3-diethylamino-7-(N-methyl-N-benzylamino)fluoran, 3-diethylamino-7-(N-chloroethyl-N-methylamino)fluoran, 3-diethylamino-7-N-diethylaminofluoran, 3-(N-ethyl-p-toluidino)-6-methyl-7-phenylaminofluoran, 3-(N-cyclopentyl-N-ethylamino)-6-methyl-7-anilinofluoran, 3-(N-ethyl-p-toluidino)-6-methyl-7-(p-toluidino)fluoran, 3-diethylamino-6-methyl-7-phenylaminofluoran, 3-diethylamino-7-(2-carbomethoxy-phenylamino)fluoran, 3-(N-ethyl-N-isoamylamino)-6-methyl-7-phenylaminofluoran, 3-(N-cyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)fluoran, 3-dibutylamino-7-(o-chlorophenylamino)fluoran, 3-pyrrolidino-6-methyl-7-p-butylphenylaminofluoran, 3-N-methyl-N-tetrahydrofurfurylamino-6-methyl-7-anilinofluoran, 3-N-ethyl-N-tetrahydrofurfurylamino-6-methyl-7-anilinofluoran, and the like.

Among the acidic compounds which develop a color by contacting with the above chromogenic materials, there are included inorganic acidic compounds such as activated clay, acid clay, attapulgite, bentonite, colloidal silica, aluminum silicate and the like; organic acidic compounds such as phenolic compounds, e.g., 4-tert-butylphenol, 4-hydroxydiphenoxide, α-naphthol, β-naphthol, 4-hydroxyacetophenol, 4-tert-octylcatechol, 2,2'-dihydroxydiphenol, 2,2'-methylenebis(4-methyl-6-tert-butylphenol), 4,4'-isopropylidenebis (2-tert-butylphenol), 4,4'-sec-butylidenediphenol, 4-phenylphenol, 4,4'-isopropylidenediphenol(bisphenol A), 2,2'-methylenebis(4-chlorophenol), hydroquinone, 4,4'-cyclohexylidenediphenol, benzyl 4-hydroxybenzoate, dimethyl 4-hydroxyphthalate, hydroquinone monobenzyl ether, novolak phenol resin, phenol polymers and the like; aromatic carboxylic acids, e.g., benzoic acid, p-tert-butylbenzoic acid, trichlorobenzoic acid, terephthalic acid, 3-sec-butyl-4-hydroxybenzoic acid, 3-cyclohexyl-4-hydroxybenzoic acid, 3,5-dimethyl-4-hydroxybenzoic acid, salicylic acid, 3-isopropylsalicylic acid, 3-tert-butylsalicylic acid, 3-benzylsalicylic acid, 3-(α-methylbenzyl)salicylic acid, 3-chloro-5-(α-methylbenzyl)salicylic acid, 3,5-di-tert-butylsalicylic acid, 3-phenyl-5-(α,α-dimethylbenzyl) salicylic acid, 3,5-di-α-methylbenzylsalicylic acid and the like; and salts of the above phenolic compounds or aromatic carboxylic acids with polyvalent metals such as zinc, magnesium, aluminum, calcium, titanium, manganese, tin and nickel.

The ratio of the color forming materials and the color developing materials used in the present invention may be suitably selected depending on the kind of the color forming material and the color developing material, accordingly is not particularly limited. However, when basic chromogenic materials and acidic compounds are used, the amount of the acidic compounds is generally within the range of 1 to 50 parts by weight, preferably within the range of 1 to 10 parts by weight, per one part by weight of the chromogenic materials.

The coating composition may be prepared by dispersing, simultaniously or separately, the color forming material and the color developing material in an aqueous medium with the use of a mixer or pulverizer such as ball mill, attritor, sand mill or the like.

The coating composition usually may comprise a binder in an amount of 10 to 70%, preferably 15 to 50% by weight on the basis of total solid amount. Among the useful binder materials there may be included starches, hydroxyethylcellulose, methylcellulose, carboxymethyl cellulose, gelatin, casein, gum arabic, polyvinyl alcohol, salts of diisobutylene-maleic anhydride copolymer, salts of styrene-maleic anhydride copolymer, salts of ethylene-acrylic acid copolymer, salts of styrene-acrylic acid copolymer, natural rubber emulsions, styrene-butadiene copolymer emulsions, acrylonitrile-butadiene copolymer emulsions, methyl methacrylate-butadiene copolymer emulsions, polychloroprene emulsions, polyvinyl acetate emulsions, ethylene-vinyl acetate copolymer emulsions and the like.

The coating composition may include additives such as dispersing agents, e.g., sodium dioctylsulfosuccinate, sodium dodecylbenzenesulfonate, sodium lauryl sulfate, alginates and metal salts of fatty acids; ultraviolet ray absorber, e.g., benzophenone compounds and triazole compounds; antifoaming agent; fluorescent dyes; coloring dyes and the like.

Further, in the coating composition, there may be added lubricants such as zinc stearate, calcium stearate, polyethylene wax, carnauba wax, paraffin wax and ester wax; inorganic pigments such as calcium carbonate, zinc oxide, aluminum oxide, titanium dioxide, silicon dioxide, aluminum hydroxide, barium sulfate, zinc sulfate, talc, kaolin, clay, calcined clay, coloidal silica and the like; organic pigments such as styrene microballs, Nylon powder, polyethylene powder, urea-formaldehyde resin filler, raw starch and the like; fatty acid amides such as stearic acid amide, methylenebis stearic acid amide, oleic acid amide, palmitic acid amide, coconut aliphatic acid amide and the like; dibenzyl terephthalate, 1,2-di(3-methylphenoxy)ethane, 1,2-diphenoxyethane, diphenylmethyl 4,4'-ethylenedioxy-bis-benzoate, hindered phenols such as 1,1,3-tris(2-methyl-4-hydroxy-5-tert-butylphenyl)butan, 2,2'-methylene-bis(4-methyl-6-tert-butylphenol), 4,4'-butylidenebis(6-tert-butyl-3-methylphenol) and the like; and various known heat-fusible materials.

When an inorganic or organic pigment is contained in the coating composition to form the recording layer, it is preferable to use pigments having a diameter as small as possible, the most preferably to use pigments having a diameter of 2 μm or less.

In order to form the recording layer according to the invention, there may be applied any conventional coating technique. For example, a coating composition is coated on the middle layer with an air-knife coator, a blade coator or the like, and then dried. The amount of the applied coating composition is generally within 2 to 12 g/m$^2$, preferably 3 to 10 g/m$^2$ on dry basis.

The base sheet used in the invention is not also limited. Among the base sheets, there are included papers such as wood free paper, base paper made by Yankee machine, single-faced machine grazed paper, double-faced machine grazed paper, cast-coated paper, art paper, coated paper, light weight coated paper and the like; synthetic fiber paper; synthetic resin films and the like.

The heat-sensitive record materials, if desired, may be smoothed after forming a middle layer and/or a recording layer by super-calendering or the like. Further, an over-coating layer may be applied on it to protect the recording layer. Various known additional techniques in the process for producing heat-sensitive record materials, such as forming a back coating on the base sheet and the like, may be applicable.

Since thus obtained heat-sensitive record materials according to the present invention have a middle layer consisting of a specific composition between the base sheet and the heat-sensitive recording layer, they are superior in record sensitivity and can develop good color images superior in color density and image quality.

PREFERRED EMBODIMENTS OF THE INVENTION

The following examples serve to illustrate the invention in more detail although the invention is not limited to the examples. Unless otherwise indicated, parts and % signify parts by weight and % by weight, respectively.

EXAMPLE 1

(1) Formation of a middle layer on a base sheet:

The following composition was mixed to prepare a coating composition (1) having a solid amount of 45% and a pH of 7.5.

| | |
|---|---|
| calcined clay (Ansilex manufactured by Engelhard Minerals & Chemicals Corporation, oil absorption: 110 cc/100 g) | 100 parts |
| styrene-butadiene copolymer latex (Dow-1571 manufactured by Asahi Kasei Kabushiki Kaisha, solid amount: 48%) | 17 parts |
| 25% aqueous solution of oxidized starch | 20 parts |
| Acrylic thickener (Somarex-50 manufactured by Somar Manufacturing Co., Ltd., solid amount: 23%, an aqueous emulsion comprising noncrosslinked resin soluble in alkaline water together with a polyol compound) | 1.5 parts |
| water | 113 parts |

The coating composition was coated on wood free paper of 50 g/m$^2$ on a paper-making machine by a blade-coater (on machine coating) in the weight of an amount of 7 g/m$^2$ on dry basis and dried to form a middle layer.

(2) Preparation of dispersion A:

The following composition was pulverized by a sand mill.

| | |
|---|---|
| 3-(N-cyclohexyl-N-methylamino)-6-methyl-7-phenylaminofluoran | 10 parts |
| 1,2-bis-(3-methylphenoxy)ethane | 15 parts |
| 5% aqueous solution of methylcellulose | 15 parts |
| water | 80 parts |

Pulverization was continued until an average particle size of 3 μm.

(3) Preparation of dispersion B:

The following composition was pulverized by a sand mill.

| | |
|---|---|
| 4,4'-isopropylidenediphenol | 30 parts |
| 5% aqueous solution of methylcellulose | 30 parts |

-continued

| | |
|---|---|
| water | 70 parts |

Pulverization was continued until an average particle size of 3 μm.

(4) Making a heat-sensitive record material:

The following composition was mixed to prepare a coating composition.

| | |
|---|---|
| dispersion A | 120 parts |
| dispersion B | 130 parts |
| amorphous silica | 30 parts |
| 20% aqueous solution of oxidized starch | 150 parts |
| water | 55 parts |

The coating composition was coated on the middle layer of the above base sheet in the weight of an amount of 5 g/m$^2$ on dry basis with use of an air-knife coater, dried and super-calendered to obtain a heat-sensitive record material.

EXAMPLE 2

A heat-sensitive record material was obtained in the same manner as in Example 1 except that 0.5 parts of an acrylic thickener (Primal ASE-75 manufactured by Japan Acryl Chemical Co., Ltd., solid amount: 40%, an aqueous emulsion comprising a noncrosslinked resin soluble in alkaline water) was used instead of 1.5 parts of the acrylic thickener (Somarex-50) to prepare the middle layer coating composition having a pH of 7.5.

EXAMPLE 3

A heat-sensitive record material was obtained in the same manner as in Example 1 except that amorphous silica (oil absorption: 200 cc/100 g) was used instead of calcined clay to prepare the middle layer coating composition having a pH of 7.0.

EXAMPLE 4

A heat-sensitive record material was obtained in the same manner as in Example 1 except that 1.8 parts of an acrylic thickener (Primal ASE-108 manufactured by Japan Acryl Chemical Co., Ltd., solid amount: 20%, an aqueous emulsion comprising a crosslinked resin swellable in alkaline water) was used instead of 1.5 parts of the acrylic thickner (Somarex-50) to prepare the middle layer coating composition having a pH of 7.2.

EXAMPLE 5

A heat-sensitive record material was obtained in the same manner as in Example 1 except that 1.2 parts of an acrylic thickener (Viscalex EM-15 manufactured by Allied Colloids Limited, solid amount: 17%, an aqueous emulsion comprising a crosslinked resin swellable in alkaline water) was used instead of 1.5 parts of the acrylic thickener (Somarex-50) to prepare the middle layer coating composition having a pH of 7.2.

EXAMPLE 6

A heat-sensitive record material was obtained in the same manner as in Example 1 except that 80 parts of calcined clay and 20 parts of amorphous silica (oil absorption: 200 cc/100 g) were used instead of 100 parts of calcined clay to prepare the middle layer coating composition having a pH of 7.1.

EXAMPLE 7

A heat-sensitive record material was obtained in the same manner as in Example 1 except that 78 parts of calcined clay, 2 parts of magnesium carbonate and 20 parts of amorphous silica (oil absorption: 200 cc/100 g) were used instead of 100 parts of calcined clay to prepare the middle layer coating composition having a pH of 8.5.

EXAMPLE 8

A heat-sensitive record material was obtained in the same manner as in Example 1 except that 0.75 parts of an acrylic thickener (Primal ASE-95 manufactured by Japan Acryl Chemical Co., Ltd., solid amount: 20%, an aqueous emulsion comprising a noncrosslinked resin soluble in alkaline water) and 114 parts of water were used instead of 1.5 parts of the acrylic thickner (Somarex-50) and 113 parts of water to prepare the middle layer coating composition having a pH of 7.2, and the coating composition was coated on wood free paper of 50 g/m$^2$ by off machine coating, but not on machine coating, to produce the middle layer.

EXAMPLE 9

A heat-sensitive record material was obtained in the same manner as in Example 1 except that 1.25 parts of an acrylic thickener (Primal ASE-60 manufactured by Japan Acryl Chemical Co., Ltd., solid amount: 28%, an aqueous emulsion comprising a crosslinked resin swellable in alkaline water) and 114 parts of water were used instead of 1.5 parts of the acrylic thickner (Somarex-50) and 113 parts of water to prepare the middle layer coating composition having a pH of 7.4, and the coating composition was coated on wood free paper of 50 g/m$^2$ by off machine coating, but not on machine coating, to produce the middle layer.

EXAMPLE 10

A heat-sensitive record material was obtained in the same manner as in Example 1 except that 0.87 parts of an acrylic thickener (Somarex-70 manufactured by Somar Manufacturing Co., Ltd., solid amount: 23%, an aqueous emulsion comprising a noncrosslinked resin solble in alkaline water) and 114 parts of water were used instead of 1.5 parts of the acrylic thickener (Somarex-50) and 113 parts of water to prepare the middle layer coating composition having a pH of 7.3, and the coating composition was coated on wood free paper of 50 g/m$^2$ by off machine coating, but not on machine coating, to produce the middle layer.

COMPARATIVE EXAMPLE 1

A heat-sensitive record material was obtained in the same manner as in Example 1 except that the acrylic thickener (Somarex-50) was not used and the water amount was increased to 114 parts to prepare the middle layer coating composition having a pH of 7.2.

COMPARATIVE EXAMPLE 2

A heat-sensitive record material was obtained in the same manner as in Example 1 except that 0.35 parts of carboxymethylcellulose (Celogen WS-C manufactured by Dai-ichi Kogyo Seiyaku Kabushiki Kaisha) was used instead of 1.5 parts of the acrylic thickener (Somarex-50) and the water amount was increased to 115 parts to prepare the middle layer coating composition having a pH of 7.5.

COMPARATIVE EXAMPLE 3

A heat-sensitive record material was obtained in the same manner as in Example 1 except that 0.35 parts of sodium alginate (Kelgin MV manufactured by Sansho Kabushiki Kaisha) was used instead of 1.5 parts of the acrylic thickener (Somarex-50) and the water amount was increased to 115 parts to prepare the middle layer coating composition having a pH of 7.5.

COMPARATIVE EXAMPLE 4

A heat-sensitive record material was obtained in the same manner as in Example 1 except that the acrylic thickener (Somarex-50) was not used and 17 parts of an acryl latex (Primal AC-61 manufactured by Rohm and Haas Japan Limited, solid amount: 47%, pH of 9.8) was used instead of 17 parts of the binder Dow 1571 to prepare the middle layer coating composition having a pH of 8.2.

The viscosity of the above acryl latex, which was measured by B-type viscosimeter (Rotor No. 1, 12 rpm) at 25° C. after duliting the latex to produce an aqueous dispersion having a solid amount of 1% and adjusting the pH of the dispersion to 8.0, was 5 cps.

EXAMPLE 11

A heat-sensitive record material was obtained in the same manner as in Example 1 except that 5.2 parts of the acrylic thickener (Somarex-50) and 112 parts of water were used instead of 1.5 parts of the acrylic thickener (Somarex-50) and 113 parts of water to prepare the middle layer coating composition having a pH of 7.0.

EXAMPLE 12

A heat-sensitive record material was obtained in the same manner as in Example 1 except that 8.7 parts of the acrylic thickener (Somarex-50) and 110 parts of water were used instead of 1.5 parts of the acrylic thickener (Somarex-50) and 113 parts of water to prepare the middle layer coating composition having a pH of 6.5.

The properties of thus obtained 16 middle layer coating compositions (solid amount: 45%) were evaluated by the following methods. The results are shown in Table 1.

Viscosity

The viscosity was measured by B-type viscosimeter (26° C., 60 rpm).

High shear viscosity

The high shear viscosity was measured by Hercules high shear viscometer (HR-801 C type manufactured by Kumagai Riki Kogyo Kabushiki Kaisha, E bob, 8800 rpm).

Water retention

Water retention was measured by S. D. Warren Method in which the electric conductivity of paper was measured. It was shown with the time required for the electric current between the electrodes to become 0.2 mA after coating the coating composition on the surface of base paper.

Easiness of the preparation of coating composition

The easiness of the perparation of coating composition was evaluated by visual observation as follows.

O . . . It is easy to prepare.
Δ . . . It is slightly difficult to prepare.
X . . . It is difficult to prepare.

Coating Applicability

The blade-coating applicability was evaluated by visual observation of streak-generation troubles such as streaks, stalactites and the like and scratchy troubles generated by the transfer failure of the coating composition to the applicator roll. The results are shown in Table 1.

O . . . Any trouble is not generated.
Δ . . . Some troubles were generated in some cases.
X . . . Many troubles were generated.

TABLE 1

| | viscosity*1 of 1% solution of thickener (cps) | Properties of middle layer coating composition | | | | | |
|---|---|---|---|---|---|---|---|
| | | added*2 amount of thickener | viscosity (cps) | high shear viscosity (poise) | water retention (sec.) | preparation of coating composition | coating applicability |
| Example | | | | | | | |
| 1 | 200 | 0.35 | 880 | 0.37 | 65 | O | O |
| 2 | 150 | 0.20 | 830 | 0.38 | 67 | O | O |
| 3 | 200 | 0.35 | 890 | 0.39 | 62 | Δ | O |
| 4 | 1230 | 0.35 | 900 | 0.38 | 60 | O | O |
| 5 | 400 | 0.20 | 870 | 0.38 | 63 | O | O |
| 6 | 200 | 0.35 | 910 | 0.38 | 60 | O | O |
| 7 | 200 | 0.35 | 980 | 0.39 | 62 | O | O |
| 8 | 1450 | 0.15 | 860 | 0.38 | 63 | O | O |
| 9 | 1100 | 0.35 | 910 | 0.38 | 65 | O | O |
| 10 | 350 | 0.20 | 850 | 0.36 | 70 | O | O |
| 11 | 200 | 1.2 | 1050 | 0.38 | 66 | O | O |
| 12 | 200 | 2.0 | 1130 | 0.39 | 67 | Δ | O |
| Comparative Example | | | | | | | |
| 1 | — | — | 200 | 0.40 | 45 | Δ | × |
| 2 | 650 | 0.35 | 680 | 0.45 | 53 | × | Δ |
| 3 | 710 | 0.35 | 700 | 0.46 | 51 | × | Δ |
| 4 | — | — | 250 | 0.42 | 50 | Δ | × |

*1The viscosity of the thickener was measured by the following steps; diluting the thickener to produce an aqueous solution or dispersion having a solid amount of 1%, adjusting the pH of the solution or dispersion to 8.0 and measuring the viscosity of it by B-type viscosimeter (Rotor No. 2, 12 rpm) at 25° C.

*2The added amount of the thickener is shown by weight parts per 100 parts by weight of pigment on dry basis.

Additionally, each of the above 16 heat-sensitive record materials was recorded by a thermal printer to develop a color image. The optical density of the color image was measured by Macbeth densitometer RD-100R manufactured by Macbeth Corp.

Furthermore, the quality of images was evaluated by visual observation respectively. The results are shown in Table 2.

The criterion of the evaluation descrived below was used.

O . . . It is good.

X . . . It is bad.

TABLE 2

| | optical density of the color images | quality of image |
|---|---|---|
| Example | | |
| 1 | 1.42 | ○ |
| 2 | 1.40 | ○ |
| 3 | 1.41 | ○ |
| 4 | 1.39 | ○ |
| 5 | 1.38 | ○ |
| 6 | 1.42 | ○ |
| 7 | 1.44 | ○ |
| 8 | 1.41 | ○ |
| 9 | 1.40 | ○ |
| 10 | 1.42 | ○ |
| 11 | 1.40 | ○ |
| 12 | 1.39 | ○ |
| Comparative Example | | |
| 1 | 1.32 | × |
| 2 | 1.33 | × |
| 3 | 1.32 | × |
| 4 | 1.33 | × |

As shown in Table 1 and 2, each of the middle layer coating compositions in Examples according to the invention has a good coating ability and the record materials obtained with use of the compositions can develop color images having a good quality and a superior color density.

What we are claimed:

1. A heat-sensitive record material having a heat-sensitive recording layer on a base sheet, in which a middle layer mainly comprising a binder and at least one pigment having an oil absorption of at least 80 cc/100 g measured by JIS K 5101 is formed between the heat-sensitive recording layer and the base sheet, characterized in that the middle layer comprises an acrylic thickener in an amount of 0.05 to 5 parts by weight per 100 parts by weight of the pigment on a dry basis.

2. A heat-sensitive record material as defined in claim 1, wherein the pigment is calcined clay and/or amorphous silica.

3. A heat-sensitive record material as defined in claim 1, wherein the middle layer is formed from a coating composition comprising the acrylic thickener in the form of an aqueous emulsion.

4. A heat-sensitive record material as defined in claim 3, wherein the aqueous emulsion comprises a non-crosslinked acrylic resin soluble in alkaline water.

5. A heat-sensitive record material as defined in claim 1, wherein acrylic thickener has a viscosity of at least 50 cps in the state of an aqueous solution having a solid amount of 1% by weight and pH of 8.0, which is measured by Brookfield viscosimeter with 12 rpm at 25° C.

6. A heat-sensitive record material as defined in claim 1, wherein the acrylic thickener is used in an amount of 0.1 to 1.7 parts by weight per 100 parts by weight of the pigment on a dry basis.

7. A method for producing a heat-sensitive record material, characterized in blade-coating on a base sheet a coating composition which mainly comprises at least one pigment having an oil absorption of at least 80 cc/100 g measured by JIS K 5101 and a binder, the coating composition comprising an acrylic thickener in an amount of 0.05 to 5 parts by weight per 100 parts by weight of the pigment on a dry basis, and forming a recording layer on the middle layer.

8. A method for producing a heat-sensitive record material as defined in claim 7, wherein the pigment is calcined clay and/or amorphous silica.

9. A method for producing a heat-sensitive record material as defined in claim 7, wherein the acrylic thickener is an aqueous emulsion.

10. A method for producing a heat-sensitive record material as defined in claim 9, wherein the aqueous emulsion comprises a non-crosslinked acrylic resin soluble in alkaline water.

11. A method for producing a heat-sensitive record material as defined in claim 7, wherein the middle layer is formed on the base sheet by a blade coater attached on a paper machine.

* * * * *